US006305163B1

(12) United States Patent
Paakkunainen

(10) Patent No.: US 6,305,163 B1
(45) Date of Patent: Oct. 23, 2001

(54) METHOD FOR ADJUSTING SUPPLY PRESSURE

(75) Inventor: Marko Paakkunainen, Tampere (FI)

(73) Assignee: Plustech Oy, Tampere (FI)

( * ) Notice: Subject to any disclaimer, the term of this patent is extended or adjusted under 35 U.S.C. 154(b) by 0 days.

(21) Appl. No.: 09/462,948

(22) PCT Filed: May 28, 1998

(86) PCT No.: PCT/FI98/00451

§ 371 Date: Jan. 17, 2000

§ 102(e) Date: Jan. 17, 2000

(87) PCT Pub. No.: WO99/61804

PCT Pub. Date: Dec. 2, 1999

(51) Int. Cl.[7] ..... F15B 15/06
(52) U.S. Cl. ..... 60/422; 60/452
(58) Field of Search ..... 60/422, 446, 452

(56) References Cited

U.S. PATENT DOCUMENTS 3,090,362 5/1963 Rolls .
4,528,813 * 7/1985 Izumi et al. ..... 60/452 X
5,666,806 * 9/1997 Dietz ..... 60/452 X

FOREIGN PATENT DOCUMENTS

3347000 A1 4/1985 (DE) .
3546336 A1 2/1987 (DE) .
3535771 A1 9/1987 (DE) .
4307827 A1 7/1993 (DE) .
0104613 A2 4/1984 (EP) .
1209658 3/1960 (FR) .
819864 9/1959 (GB) .
WO 92/05374 2/1992 (WO) .

* cited by examiner

*Primary Examiner*—John Ryznic
(74) *Attorney, Agent, or Firm*—Quarles & Brady LLP

(57) ABSTRACT

The invention relates to a method for adjusting supply pressure ($p_s$) in a hydraulic system. The method comprises a feeder pump (23) for producing the supply pressure ($p_s$), at least two hydraulic actuators (8*a*, 8*b*, 8*c*), measuring means for measuring the pressure levels of the actuators (8*a*, 8*b*, 8*c*), and a pressurized medium flow channel system. In the method, it is examined, in which actuators (8*a*, 8*b*, 8*c*) the load pressure is caused by moving a load (positive work). From the pressure levels of the actuators (8*a*, 8*b*, 8*c*) performing load-moving work, the highest is selected, and the supply pressure ($p_s$) is adjusted on the basis of the selected pressure level.

8 Claims, 7 Drawing Sheets

METHOD FOR ADJUSTING SUPPLY PRESSURE

Figures 1A, 1B:
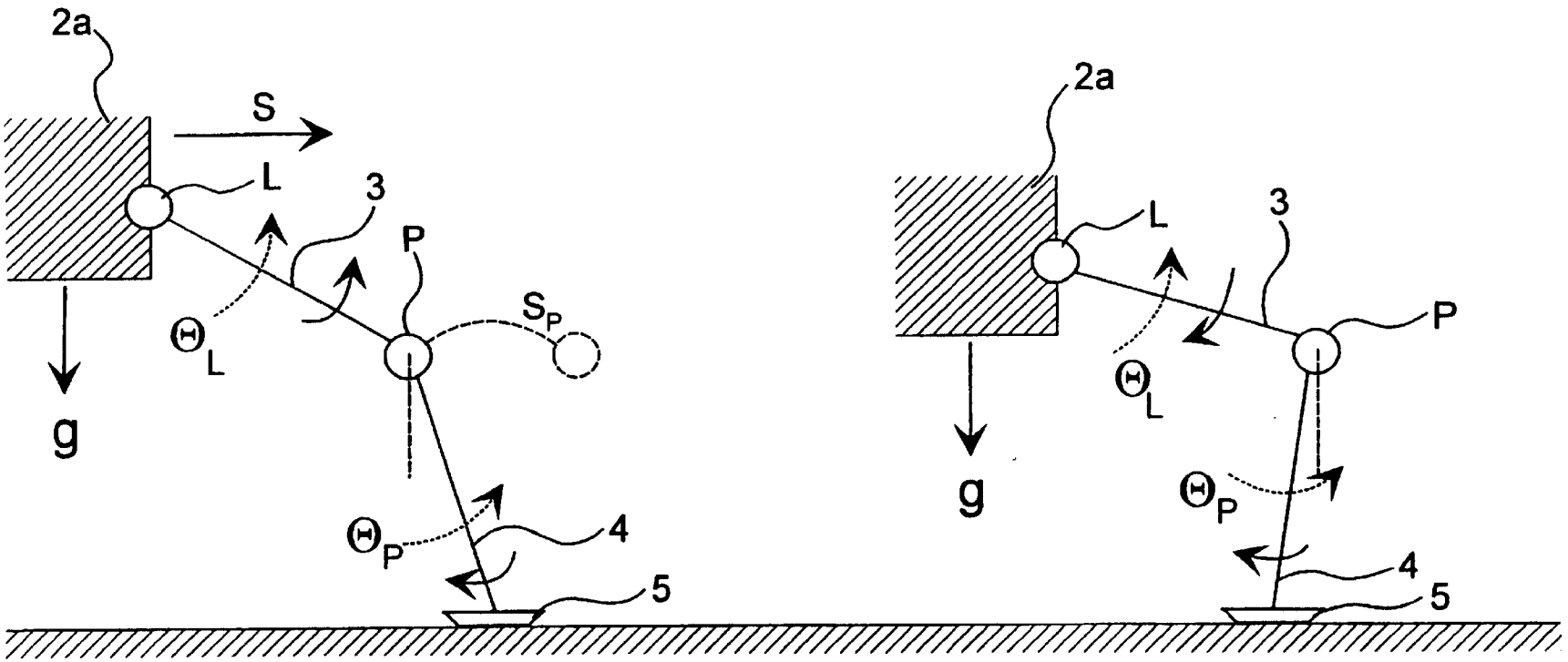

The present invention relates to a method for adjusting supply pressure in a hydraulic system comprising a feeder pump for producing the supply pressure, at least two hydraulic actuators, measuring means for measuring the pressure level of the actuators, and a pressurized medium flow channel system. The invention relates also to a hydraulic system according to the method.

Particularly for forest machines, systems have been developed in which the progressive movement of the forest machine is implemented with mechanical legs instead of wheels. Such a forest machine causes less damage to the undervegetation in the forest. Moreover, on a difficult terrain it is easier to move with legs than with a forest machine equipped with wheels.

To secure sufficient reliability and locomotion, a walking machine implemented with presently known technology requires six legs, each leg requiring three degrees of freedom. Thus, the machine has a total of 18 so-called servo shafts. To use all these servo shafts with an optimum coefficient of occupation, each servo shaft would require a separate servo pump, i.e. a total of 18 servo pumps. In practical applications, a limit is set by e.g. the price, space requirements, reliability and maintainability to the number of pumps used and to the way of control used. In practice, the number of pumps is limited to one or two, and the way of control used in the actuators is valve gearing.

In view of the efficiency, it is important to adjust the hydraulic supply pressure in such a way that the supply pressure corresponds to the highest load pressure perceivable with the actuators. This method is known as such as a so-called load sensing (LS) hydraulic system. A typical load sensing hydraulic system is presented e.g. in German patent publication DE 35 46 336. In practice, load sensing hydraulic systems are implemented in a mechanical hydraulic manner by utilizing so-called load sensing valves manufactured for this purpose. When the actuator is moved, a particular load sensing channel is opened in these valves to a particular exchange counter-valve chain integrated in the valve system. By utilizing this chain, the highest load pressure $P_{Lmax}$ required for moving the actuators is obtained for the regulator of the pump. The pump regulator adjusts the pump supply pressure $p_s$ for a pre-set pressure difference $\Delta_p$ above the level corresponding to the maximum load pressure $P_{Lmax}$ securing that all movements can be made.

European patent application EP 104 613 presents an electrohydraulic system particularly for machines with several operating cylinders. One such example is a tractor shovel with separate cylinders for turning and lifting the shovel and a hydraulic motor for moving the tractor shovel. The system presented in the publication is aimed at achieving a volume flow which is optimal in the respective loading situation. The system applies two pumps with unequal maximum output flows. Thus, it is possible either to use any of the pumps alone or, with greater loads, to use both pumps simultaneously. The system is controlled on the basis of signals generated by sensors (speed/position) coupled to the cylinders as well as control commands given by the operator of the machine in such a way that the volume flows produced by the pumps correspond to the respective use and load situation. Nevertheless, this publication does not disclose the special feature of the present application that to determine the pressure need, only the pressure level of those actuators is used which effect positive work.

German patent application DE 35 35 771 presents a hydraulic system with a hydraulic pump to produce pressure in the hydraulic system, valves for controlling actuators, a pressure equalization valve, and a pressure sensing line. In the system, the pressure is measured in a pressure supply circuit. A shut-off valve is connected to this supply pressure line and to a pressure measurement line. As the pressure level is maintained substantially equal in these lines, the pressure equalization valve is closed irrespective of the absolute pressure level. In a situation in which the position of the control valve for an actuator is changed, the pressure of the supply pressure line is changed and the pressure of the pressure measuring line is reduced momentarily. Consequently, the pressure difference is thus increased and a return valve is opened, wherein the pressure of the supply pressure is limited by leading the flow of the hydraulic fluid along a return channel to a hydraulic fluid container. The system is a conventionally implemented load sensing system with pressure sensing lines for the control valves. The adjustment is made hydraulically and, moreover, the system does not apply sensors for detecting the directions of movement of the actuators.

German patent application DE 43 07 827 also presents an electro-hydraulic system. In the system, the settings are given to the actuator electrically, e.g. by means of potentiometers or the like, wherein a controller determines, on the basis of the setting value of each actuator, how high a supply pressure will be needed. This is determined primarily as a sum of the volume flow required for each actuator. After this, the controller adjusts the pump to achieve the desired volume flow. In the adjustment, conventional, hydraulic load sensing valves are applied. In addition, the system combines the load sensing lines of these valves to one pressure measuring line by means of exchange counter-flow valves, wherein it is possible to measure the highest pressure level of the actuators. The pressure measuring line is equipped with a pressure sensor to measure the pressure electrically. Also in the system presented in this German publication, a load sensing control valve is required, which complicates, among other things, the structure of the hydraulic system and need for its maintenance and adjustability.

German patent application DE 35 32 816 presents a control system for a hydraulic system. The hydraulic system comprises two or more actuators and at least one pump. In this publication, the basic idea is that in a situation in which the supply pressure produced by the pump is not sufficient, the supply pressure of each actuator is substantially reduced in the same proportion. The purpose of this is to secure that all the control valves will be adjustable and that the volume flow will not escape to any control valve. This auxiliary pump is controlled by the actuator which requires the highest pressure level. The system is a conventional pressure sensing hydraulic system which does not apply any electrical measuring and control means.

German patent application DE 33 47 000 discusses an electro-hydraulic control system. The electro-hydraulic system presented in the publication controls a bidirectional cylinder/hydraulic motor which comprises two actuator lines and the valves therein. These control systems of two different directions are independent of each other, except for the controller. The control system consists of two valves: a three-way valve and a 4/4 proportional valve. The control system is designed as a fail-safe type, wherein for example in case of damage to the controller, no control pressure is transferred to the hydraulic motor. Furthermore, the pressure level of the supply pressures of the hydraulic motor are measured on both sides of the piston, and these measurements can be used to adjust the control valves. The system is not aimed at adjusting the pump supply pressure but the pressures of the actuator lines. The hydraulic motor can be controlled differentially by providing the cylinder of the hydraulic motor with a fixed control on one side of the piston and, on the other side, with a control signal corresponding to the respective need for adjustment, to adjust the pressure and the volume flow. The system presented in the publication does not apply a control pump but the volume flow is produced with a constant volume pump. The presented system is relatively expensive, particularly in view of the valves.

Walking of a work machine requires precise management of the movements of the legs. This means that the use of normal load sensing valves intended for mobile machines is not possible, due to their robust structure. The highest load pressure can still be detected hydraulically by utilizing a separate counter-valve chain. Thus, however, a problem is evolved in view of the operating efficiency, due to the so-called negative or escaping load. The hydraulic system cannot separate whether the load pressure is caused by moving of the load (positive work) or decelerating of the load (negative work). Thus, in some actuators, decelerating of the load may cause a higher load pressure than moving of the load in other actuators. Thus, the system receives a wrong conception of the pressure level to be needed, wherein an unnecessarily high supply pressure is developed into the hydraulic system, which impairs the operating efficiency of the system.

The above-mentioned positive work and negative work are illustrated in FIGS. 1*a* and 1*b,* which show one leg 1 of a walking machine 2. The leg 1 comprises an upper arm 3 journalled with a hip joint L in the machine frame 2*a,* a lower arm 4 journalled with a knee joint P at the opposite end of the upper arm 3, and a treading element 5 journalled at the opposite end of the lower arm. Let us assume that the machine is moved in the direction indicated by arrow S in such a way that the height of the frame part 2*a* in relation to the ground remains constant. In the presentation below, the following definitions describing the movements of the joints in their ranges of movement are agreed upon. In the figure, the angle $\theta_p$ of the joint P is increased when the lower arm 4 is rotated counter-clockwise (indicated with a broken line) in the plane of the figure, and the angle $\theta_L$ of the joint L is increased when the upper arm 3 is rotated clockwise (indicated with a broken line) in the plane of the figure, i.e. lifted upwards. When the machine is moved in the direction of arrow S, the actuators of the lower arm 4 (not shown) turn the lower arm 4 in such a way that the lower arm 4 is turned clockwise, i.e. the angle $\theta_p$ is reduced. Thus, the knee joint P rises higher from the ground level. The movement of the knee joint P is indicated by a broken line $S_p$ in FIG. 1*a*. To keep the frame 2*a* of the machine at a constant height, the upper arm 3 must be turned counter-clockwise, wherein the angle $\theta_L$ is increased. At the stage of movement, the external turning moment directed at the lower arm 4 and primarily caused by gravitation tends to press the knee joint downwards, i.e. to turn the lower arm 4 counter-clockwise. The actuators for moving the lower arm 4 turn the lower arm 4 clockwise, which is the actual direction of motion in this situation; that is, the direction of the external turning moment is opposite to the direction of movement of the lower arm 4. Thus, the actuators for moving the lower arm 4 do positive work. Nevertheless, the external turning moment directed at the upper arm 3 and primarily caused by gravitation tends to press the hip joint downwards in relation to the knee joint, i.e. to twist the upper arm 3 counter-clockwise ($\theta_L$ is increased). In this situation, also the actuators for moving the upper arm 3 twist the upper arm 3 counter-clockwise, which is the actual direction of motion in this situation. Because the external turning moment is parallel to the direction of motion of the upper arm 3, the actuators do negative work.

The situation is reversed at the stage when the lower arm has moved substantially to the other side of the vertical position indicated with a broken line. At this stage, the weight of the frame tends to twist the lower arm 4 towards the ground level (the angle $\theta_p$ is reduced further). Also, the actuators for moving the lower arm 4 turn the lower arm in the same direction. Consequently, in this situation, the external turning moment is parallel to the direction of motion of the lower arm 4, i.e. the actuators do negative work. In a corresponding manner, the actuators for moving the upper arm 3 do positive work, because the direction of motion of the upper arm 3 is opposite to the direction of the external turning moment.

Figure 1D:
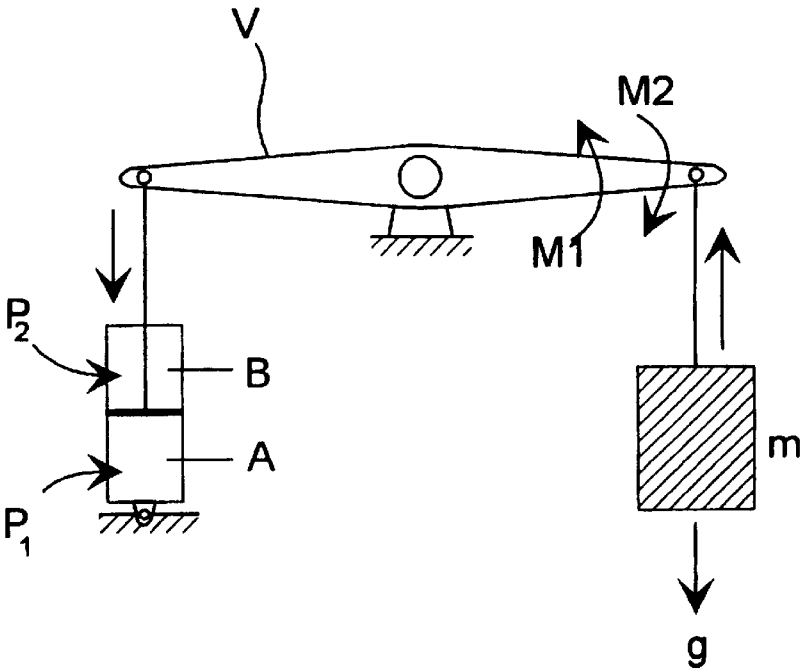
Figure 1C:
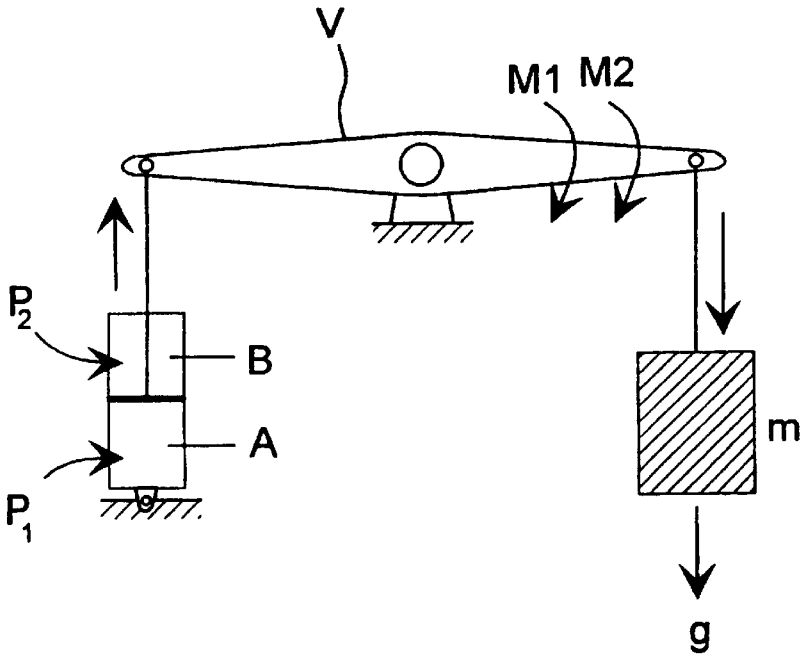

Furthermore, FIGS. 1*c* and 1*d* show the reduced difference between positive and negative work in a double acting hydraulic cylinder. The piston of the hydraulic cylinder is connected to a lever arm V, a piece m being placed at the other end of the lever arm V. In the situation of negative work illustrated in FIG. 1*c,* the piece m is moved downwards by leading pressurized medium into a first block A of the double acting hydraulic cylinder to produce a turning moment M1 in the lever arm V. In a second block B of the double acting hydraulic cylinder, there is a pressure $p_2$ which decelerates the downwards movement of the piece m. The decelerating pressure $p_2$ can be greater than the pressure $p_1$ producing the pushing force on the side of the first cylinder block A, thanks to the gravitation g directed at the piece m. The force g produces in the lever arm V a turning moment M2 whose direction is the same as the direction of motion of the piston of the cylinder. In this situation, the pressure required by the actual work is $p_1$.

In a corresponding manner, FIG. 1*d* shows a situation similar to that mentioned above, in which the piece m is lifted upwards. To produce the lifting force, i.e. the torque M1, pressurized medium is supplied to the second block B of the double acting cylinder, to produce a pressure $p_2$. The force g produces in the lever arm V a torque M2 whose direction is opposite to the direction of motion of the piston of the cylinder. The pressure required by the positive work, i.e. lifting of the piece m, is thus $p_2$ and is greater than the pressure $p_1$ in the first block A of the double acting cylinder.

In hydraulic systems according to prior art techniques, the hydraulic system would in the situation of FIG. 1*c* develop a supply pressure on the basis of the decelerating pressure $p_2$ in the second block B of the double acting cylinder, even though the smaller pressure $p_1$ would be actually sufficient.

It is an aim of the present invention to eliminate the above-mentioned drawbacks to a major extent and to provide a method and device for adjusting the supply pressure in a hydraulic system to achieve the best possible operating efficiency. The method according to the invention is characterized in that the method comprises at least the following steps:

- examining electrically the direction of motion of the actuator and the direction of effect of the external moment directed at the actuator, to find out whether the actuators does positive, load moving work,
- selecting the highest of the pressure levels of actuators doing load-moving work, and
- adjusting the supply pressure on the basis of the selected pressure level.

The hydraulic system according to the invention is characterized in that the system also comprises:

means for determining the actuators doing positive load-moving work electrically on the basis of the direction of motion of the actuator and the direction of the external moment directed at the actuator, means for selecting the highest pressure level of the pressure levels of the actuators moving the load, and means for adjusting the supply pressure on the basis of the selected pressure level.

Consequently, the invention is based on the idea of separating the actuators into load-moving actuators (positive work) and load-decelerating actuators (negative work) respectively. After this, the pressure level of load-moving actuators is examined, and the highest level is selected. The supply pressure is adjusted on the basis of the selected pressure level.

The invention gives significant advantages to solutions implemented with prior art technology. By adjusting the supply pressure of the hydraulic system by the method according to the invention, it is possible to improve the total operating efficiency of the hydraulic system, because the supply pressure is always optimal. This reduces the energy consumption of the hydraulic system. Furthermore, the reliability of the hydraulic system is improved, and service intervals can be extended, because the average load on the hydraulic system is reduced. Improved operating efficiency also increases the operating life of the hydraulic system e.g. as a result of slower wear.

Figure 2:
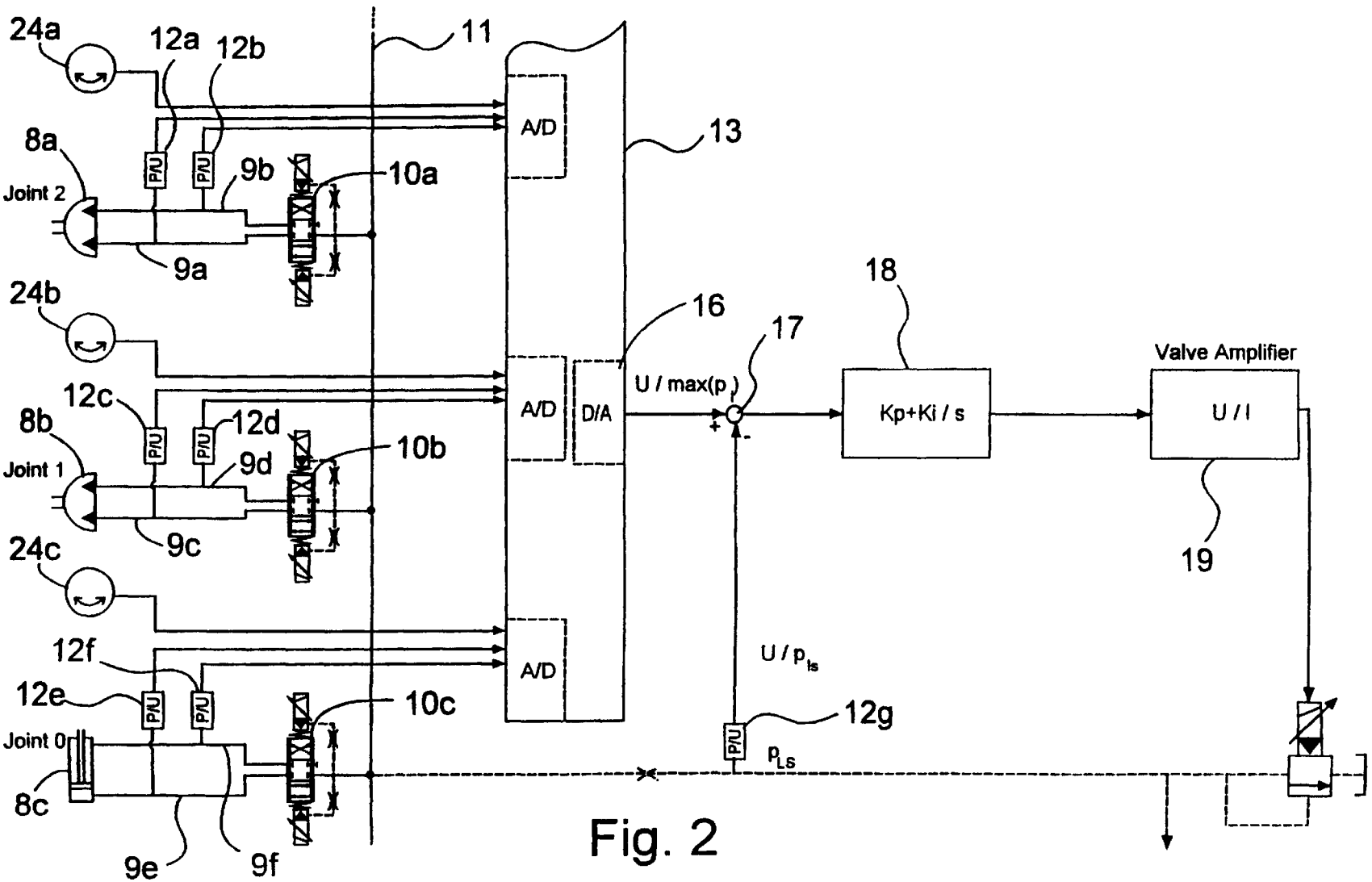
Figure 3:
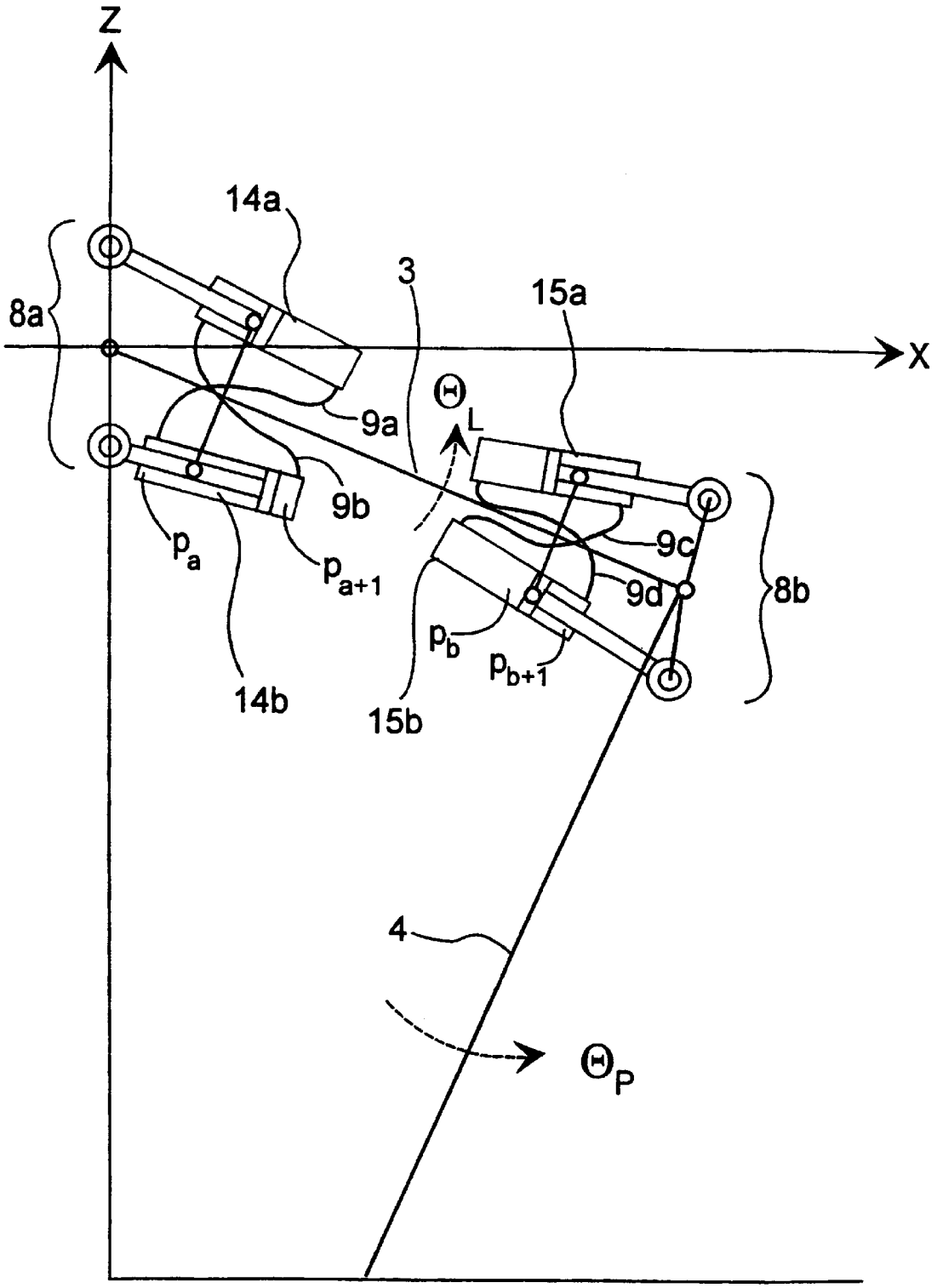
Figure 4:
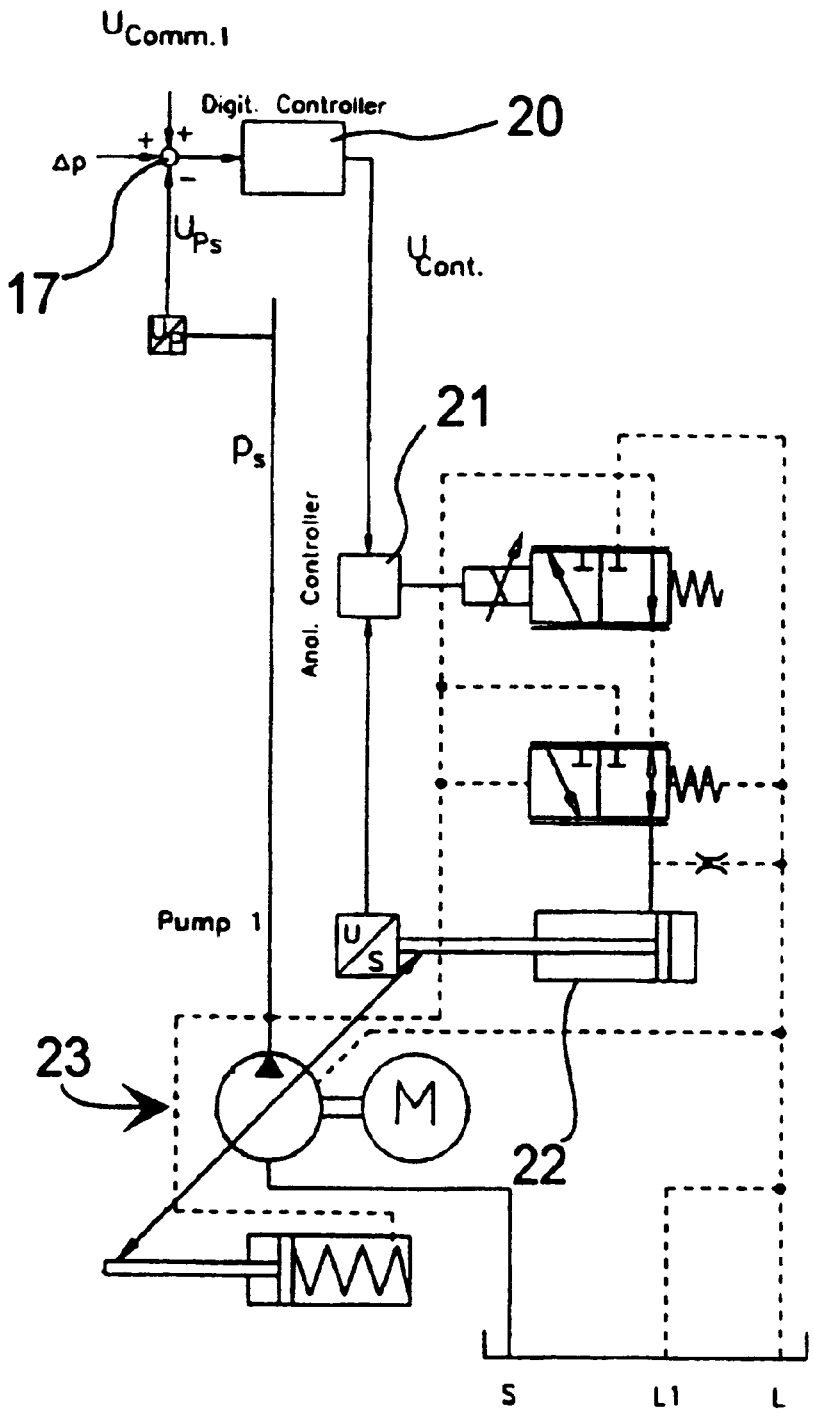
Figure 5:
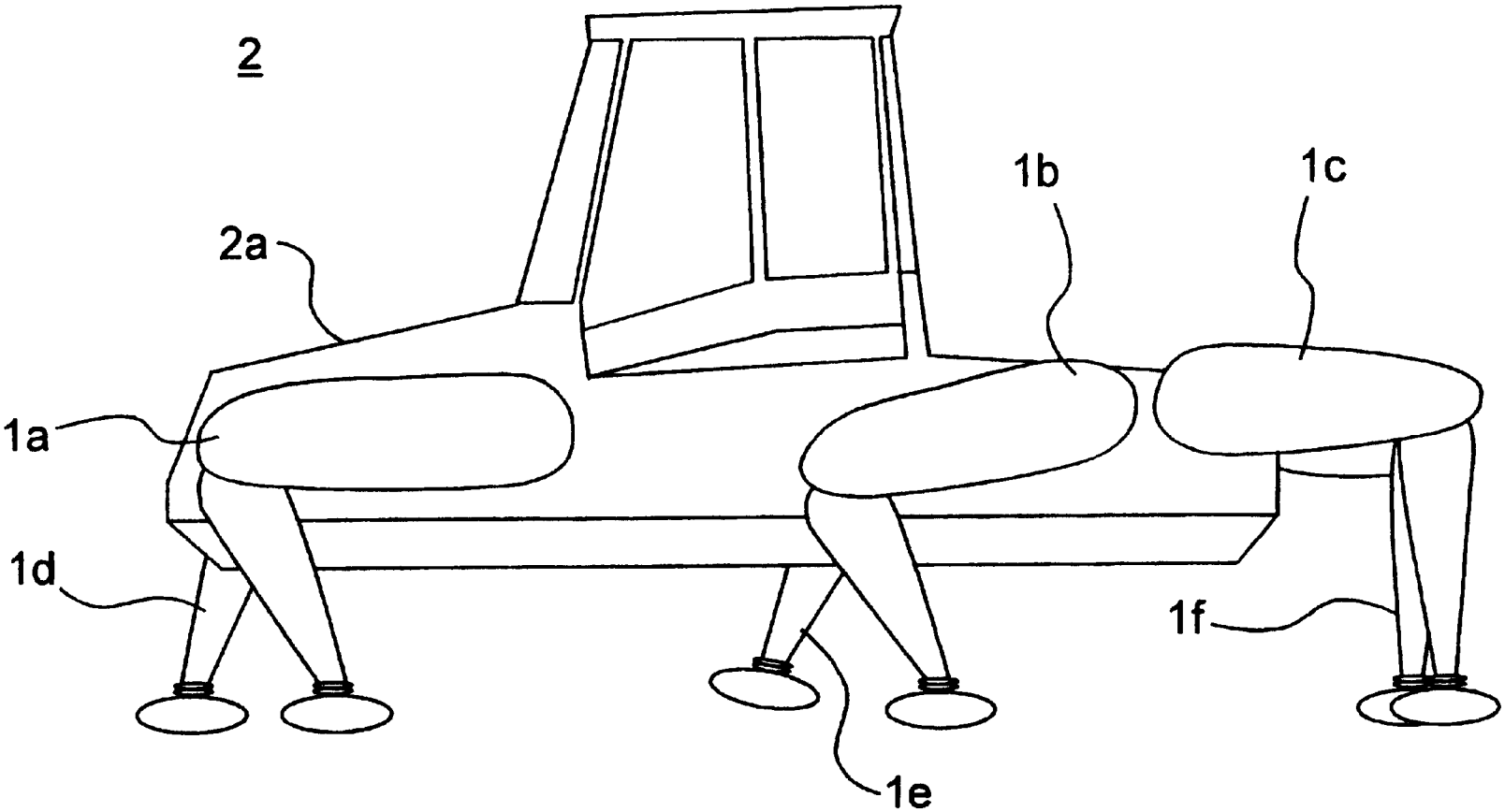
Figure 6:
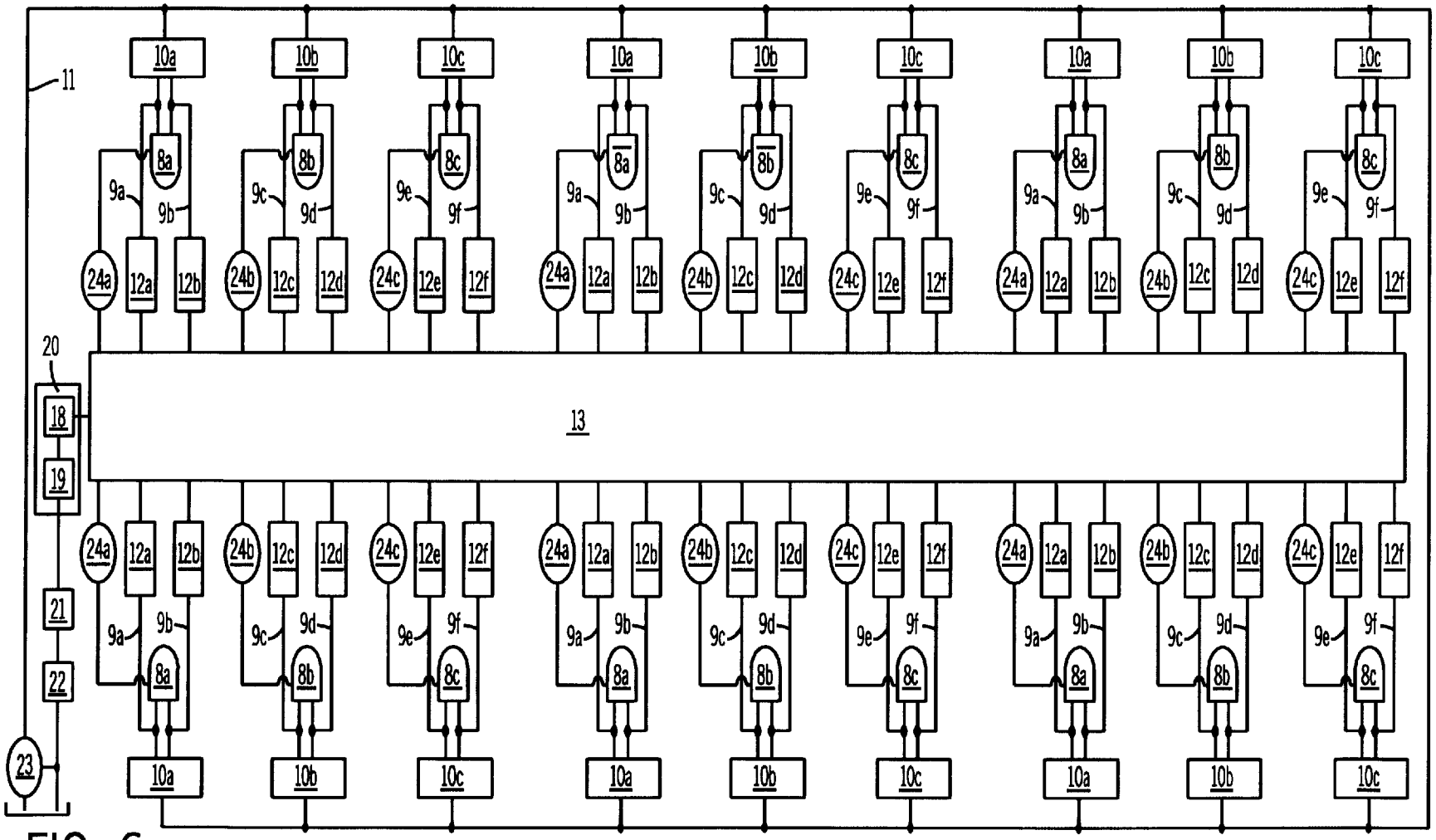

In the following, the invention will be described in more detail with reference to the appended drawings, in which FIGS. 1*a* to 1*d* illustrate the principle of positive and negative work, FIG. 2 is a reduced hydraulic chart showing the adjustment of the supply pressure of the hydraulic system according to the invention, FIG. 3 illustrates the operation of a mechanical leg in a reduced manner, FIG. 4 shows an application of pressure adjustment in a reduced hydraulic chart, FIG. 5 shows a machine in which the invention can be advantageously applied, and FIG. 6 shows a hydraulic pump system, mechanical leg actuators and control circuitry in a hydraulic chart.

A walking machine 2 requires preferably six mechanical legs 1 having advantageously six degrees of freedom. Each leg 1 comprises preferably an upper arm 3 journalled in the machine frame 2*a,* a lower arm 4 journalled at the opposite end of the upper arm 3, as well as a treading element 5 fixed at the opposite end of the lower arm. The three degrees of freedom of the mechanical leg 1 are advantageously implemented in such a way that the upper arm 3 journalled at the frame 2*a* is movable in two directions around two swivelling axes independent of each other, due to the fact that an intermediate piece is fixed to be pivotable around the swivelling axis in the longitudinal direction of the frame, the upper arm being, in turn, fixed in the same to be pivotable around an axis perpendicular to said axis. The third degree of freedom is obtained by journalling between the upper arm 3 and the lower arm 4, wherein the lower arm 4 is pivotable in the vertical plane. The treading element 5 can either be stationarily fixed to one end of the lower arm 4, or the fixing can be flexible, wherein the treading element 5 follows the roughness of the terrain to some extent.

To move each leg 1, at least one actuator 8 is needed for each degree of freedom. Thus, in connection with the hip joint, there is a first actuator 8*a* to turn the upper arm 3 and thereby the whole mechanical leg 1 with respect to the piece journalled on the frame. A second actuator 8*b* is arranged to turn the lower arm 4 in the same plane in which the upper arm 3 is turned. Moreover, a third actuator 8*c* turns the intermediate piece and the whole mechanical leg 1 around the turning axis in the longitudinal direction of the frame, i.e. in a substantially perpendicular direction with respect to the direction of movement produced by the first actuator 8*a*. The actuators 8*a, 8*b, 8*c* are preferably hydraulic cylinders or torsion motors formed by pairs of hydraulic cylinders. The implementation of the movements of the mechanical leg is known to anyone skilled in the art, wherein it is not described in more detail in this context. For example, previous Finnish patent 87171 and patent application FI-955297 by the same applicant disclose some advantageous embodiments of the leg mechanism.

In connection with the mechanical legs 1*a* to 1*f,* there are sensors by means of which it is possible to detect for each leg 1*a* to 1*f* the direction of motion, and preferably also the position, of the upper arm 3 and the lower arm 4. Furthermore, in connection with the treading elements 5 of the legs there can be sensors to detect whether the treading element 5 (and thereby also the respective leg 1) is on the ground or in the air. Moreover, in connection with the actuators 8*a* to 8*c* for moving the mechanical legs, there are sensors 12*a* to 12*f* by means of which it is possible to find out the momentary pressure level of each actuator 8*a* to 8*c,* either by means of pressure sensors or by calculation e.g. from a force vector effective on the ankle, which is at least two-, preferably three-dimensional (directions xyz). The force vector can be measured with force sensors, wherein it is possible to find out the turning moments and calculate the pressure levels. Information on the pressure level and the direction of motion is used e.g. to find out in which actuators there is positive work and in which actuators there is negative work performed.

To produce the progressive movement of the machine 2, a complex control logic is required, whereby the commands to control the actuators are transmitted to the actuators 8*a,* 8*b,* 8*c* of the mechanical legs 1*a* to 1*f.* During the progressive movement, some of the actuators 8 are moving the load in the direction of positive work and some in the direction of negative work. Both situations produce a rise in the pressure level in the pressurized medium channels of the actuators, wherein the supply pressure must be adjusted according to the need. In presently known solutions, also a change in the pressure level caused by a decelerating actuator is taken into account in the determination of the supply pressure, wherein the supply pressure can in some situations be unnecessarily high. Instead, in the present invention, the supply pressure is adjusted on the basis of load-moving actuators only, to achieve the best possible operating efficiency.

The method according to the invention will be described in the following with reference to FIGS. 2–4 and 6.

FIG. 2 shows a control circuit for one mechanical leg 1*a*. As shown in FIG. 6, in a preferred embodiment of the invention, the other control circuits are, for the essential parts, identical with the coupling shown in FIG. 2, wherein they are not presented in more detail. The actuators 8*a* to 8*c* are preferably double acting, wherein the pressurized medium can be led to the actuators either via a first actuator line 9*a,* 9*c,* 9*e* or via a second actuator line 9*b,* 9*d,* 9*f,* on the basis of the desired direction of movement of the actuator. In this preferred embodiment, the actuator lines 9*a* to 9*f* are coupled to a three-position, double acting valve 10*a* to 10*c* (4/3 directional valve). In FIG. 2, the valves are shown in the middle position, wherein no pressurized medium is led to the actuators 8*a* to 8*c*. The valves 10 are preferably electrically controllable, wherein the position of the valve 10 can be changed by an electrical control signal. This is known as such to anyone skilled in the art, wherein it is unnecessary to present it in this context. The supply pressure is led to the actuators 8*a,* 8*b,* 8*c* via a supply pressure line 11 and the valves 10*a* to 10*c.* In the supply pressure valve 11, the supply pressure of the pressurized medium is developed by means of a feeder pump and valve control in a way known as such.

To measure the pressure levels of the actuator lines 9*a,* 9*b,* the pressure message is preferably converted into a voltage or current message. For this purpose, it is possible to use pressure-voltage converters (p/U converter) 12*a* to 12*g* of prior art. The pressure-voltage converters produce a voltage which is proportional to the pressure and is led to a control unit 13. In the control unit 13, the analog voltage message produced by the p/U converter is preferably converted into a digital message by means of an analog-to-digital converter (A/D converter). Instead of a pressure-voltage converter 12*a* to 12*f,* it is also possible to use converters which convert the pressure message directly into a digital message. The digital message can be either in parallel format, i.e., a separate line is arranged for each bit, or in serial format, wherein the digital message is conveyed in successive bits along the same line. When a parallel-format converter is used, more wirings are needed than with a serial-format converter; for example, at a conversion accuracy of 8 bits, 8 separate wires are needed for each converter.

Information about the directions of movement of the arms 3, 4 of each leg is led from movement sensors 24*a,* 24*b,* 24*c* into the control unit 13. The movement sensors 24*a* to 24*c* are known as such, for example quadrature pulse sensors or pulse counters. The quadrature pulse sensors generate two pulse-format signals having the same frequency and a phase difference of e.g. ±90°, wherein preferably on the basis of the direction (+/−) of the phase difference of the signals, it is possible to deduce the direction of motion. Using pulse counters, the direction of motion can be deduced preferably from the direction of change in the count of the pulse counter, i.e. whether the count is increased or decreased. The data on the direction of motion to be led to the control unit 13 can also be a voltage message, wherein the direction of change in the voltage (increasing/decreasing) gives the direction of motion. The voltage message is preferably converted with an A/D converter into digital format. The control unit 13 uses the signal of the movement sensor 24*a* to 24*c* e.g. to deduce whether positive or negative work is done in the actuator controlling the arm 3, 4 in question.

The voltage messages, which are in digital format in the control unit 13, are led preferably to a microprocessor MPU for processing. For the application software of the microprocessor, the control unit 13 comprises also a read only memory ROM, which can also be an electrically erasable programmable read only memory EEPROM. Furthermore, the control unit 13 comprises a random access memory RAM and other control electronics. The control unit 13 can also be formed by using a so-called micro controller unit MCU, wherein most of the functions of the control unit 13 can be implemented with one integrated circuit. Advantageously, it is possible to use a microcontroller with A/D converters, a read only memory ROM, a random access memory RAM, a digital-to-analog converter (D/A converter), as well as a microprocessor MPU. The control unit 13 can also be implemented with another control means, known as such. This is prior art known to anyone skilled in the art, wherein a more detailed discussion about the control unit 13 will not be necessary in this context.

Consequently, two voltage or current messages proportional to the pressure are obtained from each actuator 8*a,* 8*b,* 8*c.* The difference between the messages coming from the same actuator reveals in which direction the actuator is moving in the case that a load is being actively moved with the actuator. FIG. 3 shows, in a reduced manner, the directions of motion of a mechanical leg in one plane, for example in the vertical plane. The first actuator 8*a,* which moves the upper arm 3 in the vertical plane preferably to achieve a pivoting movement with respect to the hip joint L, comprises preferably two hydraulic cylinders 14*a,* 14*b.* In a corresponding manner, the second actuator 8*b,* which moves the lower arm 4 in the vertical plane preferably to achieve a pivoting movement with respect to the knee joint P, comprises preferably two hydraulic cylinders 15*a,* 15*b.* The angles $\theta_L$ and $\theta_p$ marked in FIG. 3 correspond to the markings of FIGS. 1*a* and 1*b,* wherein reference is made in this context to the descriptions of FIGS. 1*a* and 1*b* presented above in this specification. Moreover, in FIG. 3, the pressure levels of the actuator lines 9*a,* 9*b* of the first actuator 8*a* are marked in the following way: $p_a$ refers to the pressure level of the first actuator line 9*a,* and $p_{a+1}$ refers to the pressure level of the second actuator line 9*b.* In a corresponding manner, the pressure levels of the actuator lines of the second actuator 8*b* are indicated with the references $p_b$ and $p_{b+1}$. The effect of the external turning moments can thus be deduced from FIG. 3. Let us assume that the leg is on the ground. Thus, when the load formed by the frame is lifted, the first actuator 8*a* for controlling the upper arm 3 tends to pivot the upper arm 3 clockwise ($\theta_L$ is reduced), and to implement this, the pressure level $p_a$ of the first actuator line 9*a* is greater than the pressure level $p_{a+1}$ of the second actuator line 9*b.* The external moment caused by the load tends to pivot the upper arm in the opposite direction ($\theta_L$ is increased). In a corresponding manner, when the load is being descended, the first actuator 8*a* tends to pivot the upper arm 3 counter-clockwise ($\theta_L$ is increased). Due to the decelerating force caused by the load, the pressure level $p_a$ of the first actuator line 9*a* is thus also greater than the pressure level $p_{a+1}$ of the second actuator line 9*b.* It can be stated that a comparison between the pressures prevailing on different sides of the actuator acting in two directions explicitly tells the direction of effect of the external moment, if the surface areas etc. are symmetrical. The same result can also be achieved by examining a situation in which the leg is in the air and the upper arm is being moved. Thus, the weight of the leg constitutes a load which causes an external moment effective in the direction "$\theta_L$ is reduced". The above-presented alternatives are compiled in the left-hand column in Table 1. The middle column presents the direction of motion of the upper arm 3 according to information given by the movement sensor, that is, the real direction of movement. The right-hand column presents the information deduced on the basis of the above-mentioned columns about the work to be done in the actuator 8*a:* "+" indicates positive work and "−" indicates negative work.

TABLE 1

| Pressure level | External turning moment | Direction of movement | Work |
|---|---|---|---|
| $p_{a+1} > p_a$ | $\theta_L$ is reduced | $\theta_L$ is increased | + |
| $p_a > p_{a+1}$ | $\theta_L$ is increased | $\theta_L$ is increased | − |
| $p_{a+1} > p_a$ | $\theta_L$ is reduced | $\theta_L$ is reduced | − |
| $p_a > p_{a+1}$ | $\theta_L$ is increased | $\theta_L$ is reduced | + |

At the lower arm 4, the situation is analogous to that presented above, with the exception that in the mechanical leg 1*a*–1*f* of the walking machine 2 according to the preferred embodiment of the invention, the pistons of the hydraulic cylinders of the second actuator 8*b* are connected to the upper arm 3, wherein, with reference to the function of the upper arm 3 presented above and the references of FIG. 3, Table 2 is obtained, in which the value of the columns corresponds to the columns of Table 1.

TABLE 2

| Pressure level | External turning moment | Direction of movement | Work |
|---|---|---|---|
| $p_{b+1} > p_b$ | $\theta_P$ is increased | $\theta_P$ is increased | – |
| $p_b > p_{b+1}$ | $\theta_P$ is reduced | $\theta_P$ is increased | + |
| $p_{b+1} > p_b$ | $\theta_P$ is increased | $\theta_P$ is reduced | + |
| $p_b > p_{b+1}$ | $\theta_P$ is reduced | $\theta_P$ is reduced | – |

In the position of FIG. 3, assuming that the leg is on the ground, the external turning moment tends to affect in the direction "$\theta_p$ is reduced". When the lower arm is on the other side of the vertical position, the turning moment affects in the direction "$\theta_p$ is increased". In this context, reference is also made to the markings of FIGS. 1*a* and 1*b* and to the discussion in connection therewith. The tables 1 and 2 above can be generalized to apply also to the other legs 1*b*–1*f*.

In the application software of the control unit 13, the pressure level of each actuator line is measured, and the position and direction of motion of the actuator, or the direction of motion of the joint, are examined with a separate movement sensor, which will also tell the direction of motion of the actuator. After this, the above-mentioned tables are applied to deduce whether positive work or negative work is done in the actuator. The pressure levels of actuators doing negative work are disregarded, and the highest of the pressure levels of the actuators doing positive work is selected. The above-mentioned operations are thus performed in the control unit 13 preferably as digital numbers, wherein the selected pressure level is converted into analog format in a digital-to-analog converter 16. From the digital-to-analog converter 16, an analog voltage message, proportional to the selected pressure level, is output to be transferred to a first adder 17. To the first adder 17 is also input a voltage message which is proportional to the supply pressure of the supply pressure line and which has been formed with a pressure-voltage converter 12*g* in the supply pressure line. Thus, the difference between the selected pressure level and the momentary pressure level of the supply pressure line is obtained from the output of the first adder 17. The difference is led to a PI controller 18, which is thus an integrating controller. The controlling value formed by the PI controller 18 is led to an amplifier 19, in which the analog voltage message is preferably converted to a current message proportional to the voltage message. By means of the current message, the adjustment of the supply pressure is made in a way known as such.

FIG. 4 shows a solution for controlling the supply pressure of a hydraulic system. In this embodiment, a safety coefficient $\Delta_p$ is led as a digital number to the input of the digital controller. In the first adder 17, the digital voltage message, which is formed by the control unit and proportional to the selected pressure level, is summed into the safety coefficient $\Delta_p$. The voltage message proportional to the supply pressure $p_s$ of the supply pressure line is deduced from the sum. The difference voltage is conveyed to a digital controller 20 which comprises preferably a digital PI controller 18, an amplifier 19, and a digital-to-analog converter. From the digital controller 20, the analog controlling signal is led to a feeder pump controller 21. A return coupling is formed to the feeder pump controller 21 on the basis of the angle of the feeder pump 23, which corresponds to the volume of rotation of the feeder pump. Thus, the feeder pump controller 21 generates a control signal to a feeder pump actuator 22 to control the angle of the feeder pump to comply with the selected pressure level.

The invention is not limited solely to the embodiments presented above, but it can be modified within the scope of the appended claims.

What is claimed is:

1. A method for adjusting supply pressure in a hydraulic system comprising a feeder pump for producing the supply pressure, at least two hydraulic actuators, measuring means for measuring the pressure level of the actuators, and a pressurized medium flow channel system, wherein the method comprises at least the following steps:

examining electrically the direction of motion of the actuator and the direction of the effect of the external moment directed at the actuator, to find out whether the actuators do positive, load moving work, selecting the highest of the pressure levels of actuators doing load-moving work, and adjusting the supply pressure on the basis of the selected pressure level.

2. The method according to claim 1, wherein the nature of work is examined by measuring in the actuators the pressure levels of the work states corresponding to the opposite directions of movement and the directions of movement achieved with the actuators, wherein on the basis of the pressure levels and direction of movement of each actuator it is deduced whether positive work is done in any of the actuators.

3. The method according to claim 1, wherein the hydraulic system is in connection with a load-bearing leg construction.

4. The method according to claim 3, wherein the hydraulic system is a hydraulic system for a walking machine, such as a forest machine.

5. A hydraulic system comprising a feeder pump for producing a supply pressure, at least two hydraulic actuators, measuring means for measuring the pressure levels of the actuators, and a pressurized medium flow channel system, wherein the hydraulic system also comprises:

means for determining the actuators performing load-moving work electrically on the basis of the direction of motion of the actuator and the direction of action of an external moment effective on the actuator means for selecting the highest pressure level of the pressure levels of those actuators which move a load, and means for adjusting the supply pressure on the basis of the selected pressure level.

6. The hydraulic system according to claim 5, wherein it comprises sensors for measuring the pressures of the work states of the actuators corresponding to opposite directions of movement, and sensors for measuring the direction of movement achieved with the actuators, as well as calculating means for separating load-moving actuators and load-decelerating actuators.

7. The hydraulic system according to claim 5, wherein the means for separating load-moving actuators and load-decelerating actuators, and the means for selecting the highest pressure level of the pressure levels of the load-moving actuators, comprise a control unit, and that the means for adjusting the supply pressure on the basis of the selected pressure level comprise a PI controller.

8. The hydraulic system according to claim 5, wherein it is a hydraulic system for a walking machine, such as a forest machine.

* * * * *